US010064460B2

(12) United States Patent
Siahaan

(10) Patent No.: US 10,064,460 B2
(45) Date of Patent: Sep. 4, 2018

(54) FRICTIONAL STABILIZATION OF BAND AND SECUREMENT MECHANISM

(71) Applicant: Apple Inc., Cupertino, CA (US)

(72) Inventor: Edward Siahaan, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/273,657

(22) Filed: Sep. 22, 2016

(65) Prior Publication Data

US 2017/0086538 A1 Mar. 30, 2017

Related U.S. Application Data

(60) Provisional application No. 62/235,515, filed on Sep. 30, 2015.

(51) Int. Cl.
*A44C 5/14* (2006.01)
*G04B 37/14* (2006.01)

(52) U.S. Cl.
CPC ..... *A44C 5/14* (2013.01); *G04B 37/1486* (2013.01); *Y10T 24/4718* (2015.01); *Y10T 24/4782* (2015.01)

(58) Field of Classification Search
CPC ... Y10T 24/4718; Y10T 24/4782; A44C 5/14; G04B 37/1486
See application file for complete search history.

(56) References Cited

U.S. PATENT DOCUMENTS 1,498,070 A * 6/1924 Beucke ..... G04B 37/1486 24/265 B
1,498,109 A * 6/1924 Mulholland ..... G04B 37/1486 24/265 B
1,704,795 A * 3/1929 Heileman ..... G04B 37/1493 24/265 B
2,126,263 A 8/1938 Kestenman
2,346,887 A 4/1944 Winkler
2,408,279 A 9/1946 Valcourt
(Continued)

FOREIGN PATENT DOCUMENTS

CN 2052214 2/1990
CN 1147358 4/1997
(Continued)

OTHER PUBLICATIONS

Author Unknown, "Ikepod Wristwatches by Mark Newson," http://www.dezeen.com/2007/12/10/ikepod-wristwatches-by-marc-newson/, 32 pages, Dec. 10, 2007.
(Continued)

*Primary Examiner* — Justin Larson
(74) *Attorney, Agent, or Firm* — McDermott Will & Emery LLP

(57) ABSTRACT

A band is disclosed which attaches to a portable electronic device. The band includes a flexible length of material which forms a loop into which a pin is inserted. In one embodiment, the loop has an insert with a protrusion therein. The protrusion frictionally contacts the pin. In another embodiment the pin includes an elastomeric surface. The elastomeric surface may include O-rings between two pin portions such that the amount of the elastomeric surface extending beyond the pin may be adjusted. In another embodiment, the elastomeric surface includes a sleeve on the pin.

20 Claims, 11 Drawing Sheets

(56) References Cited

U.S. PATENT DOCUMENTS 2,505,044 A 4/1950 Heinrich
2,518,551 A 8/1950 Jaccarino
2,536,007 A * 12/1950 Milner ..... A44C 5/142 16/257
2,948,941 A 8/1960 Bruhn
3,293,714 A 12/1966 Shafer
3,376,616 A 4/1968 Kaczorowski
3,578,208 A * 5/1971 Herzog ..... A44C 5/16 224/177
3,589,341 A 6/1971 Krebs
3,675,284 A 7/1972 Rieth
3,707,744 A 1/1973 Manzo et al.
3,740,804 A 6/1973 Levinger
3,747,171 A 7/1973 Montague, Jr.
3,818,552 A 6/1974 Droz
RE28,793 E * 5/1976 Bert ..... A44C 5/14 224/164
4,069,953 A * 1/1978 Vetter ..... A44C 5/145 224/178
4,136,805 A 1/1979 Storms
4,178,751 A 12/1979 Liautaud
4,249,267 A 2/1981 Voss
4,326,321 A * 4/1982 Colognori ..... A44C 5/14 16/229
4,414,714 A 11/1983 Kostanecki et al.
4,432,655 A 2/1984 Wollman
4,447,238 A 5/1984 Eldridge, Jr.
4,615,185 A 10/1986 Bollinger
D305,743 S * 1/1990 Hirsch ..... D11/94
4,903,253 A 2/1990 Nikles et al.
4,941,236 A 7/1990 Sherman et al.
5,130,899 A 7/1992 Larkin et al.
5,146,437 A 9/1992 Boucheron
5,168,281 A 12/1992 Tokunaga
5,244,134 A 9/1993 Riley
5,305,503 A 4/1994 Yamagata
5,307,582 A 5/1994 Quintel
5,668,784 A 9/1997 Iguchi
5,788,400 A 8/1998 Wey
5,914,913 A 6/1999 Shriqui
5,930,873 A * 8/1999 Wyser ..... A44C 5/14 224/178
5,951,193 A * 9/1999 Yamamoto ..... A44C 5/105 24/265 B
6,067,692 A 5/2000 Chang
6,163,938 A 12/2000 Weber-Unger
6,170,131 B1 1/2001 Shin
6,179,025 B1 1/2001 Sutton
6,292,985 B1 9/2001 Grunberger
6,311,373 B1 11/2001 Hashimoto
6,481,069 B1 11/2002 Cheng
6,505,385 B2 1/2003 Grunberger
6,588,069 B2 7/2003 Deriaz et al.
6,598,271 B2 7/2003 Nire
6,606,767 B2 8/2003 Wong
6,647,597 B2 11/2003 Reiter
6,678,898 B2 1/2004 Jones et al.
6,701,580 B1 3/2004 Bandyopadhyay
6,726,070 B2 4/2004 Lautner
6,746,058 B2 6/2004 Kienzler
7,243,824 B2 7/2007 Tabata
7,249,398 B2 7/2007 Roy
7,296,752 B2 11/2007 Carnevali
7,363,687 B2 4/2008 Kraus et al.
7,373,696 B2 5/2008 Schoening et al.
7,451,528 B2 11/2008 Sima
7,509,712 B2 3/2009 Sima
7,618,260 B2 11/2009 Daniel et al.
7,640,632 B2 1/2010 Lazarus
7,806,309 B2 10/2010 Korchmar
7,810,683 B2 10/2010 Chan
7,905,039 B2 3/2011 Karovic
8,088,043 B2 1/2012 Andren et al.
8,091,261 B2 1/2012 Chadwick
8,261,416 B2 9/2012 Rothbaum et al.
8,316,515 B2 11/2012 Slank
8,328,055 B1 12/2012 Snyder
8,471,658 B2 6/2013 Fullerton et al.
8,474,669 B2 7/2013 Rohrbach et al.
8,486,481 B2 7/2013 Giuseppin et al.
8,573,458 B1 11/2013 Hamilton
8,578,569 B1 11/2013 Karnoski et al.
8,615,849 B2 12/2013 Rothbaum
8,662,362 B1 3/2014 Bastian et al.
8,787,006 B2 7/2014 Golko et al.
8,789,246 B2 7/2014 Yliluoma et al.
8,857,683 B2 10/2014 Cameron et al.
8,967,437 B2 3/2015 Wilson
9,003,611 B2 4/2015 Catanese
9,049,894 B2 6/2015 Wong
9,101,184 B2 8/2015 Wilson
9,245,678 B2 1/2016 Fiedler
9,258,670 B2 2/2016 Goyal et al.
9,314,092 B2 4/2016 Wang et al.
9,351,551 B2 5/2016 Morgan et al.
9,357,817 B2 6/2016 Lee et al.
9,392,829 B2 7/2016 Manuello
D798,189 S * 9/2017 Nielsen ..... D10/128
9,826,789 B2 * 11/2017 Dey ..... A41D 20/00
2005/0102802 A1 5/2005 Sitbon et al.
2005/0265132 A1 12/2005 Ho
2006/0156520 A1 7/2006 Meranto
2006/0186150 A1 8/2006 Willows et al.
2006/0254105 A1 11/2006 Chang
2007/0028429 A1 2/2007 Ishida
2007/0070823 A1 3/2007 Sima
2007/0279852 A1 12/2007 Daniel et al.
2008/0210722 A1 9/2008 Ishihara et al.
2009/0020570 A1 1/2009 Chan
2009/0133438 A1 5/2009 Stampfli et al.
2009/0265832 A1 10/2009 Clement
2010/0032462 A1 2/2010 Cameron et al.
2010/0200627 A1 8/2010 Shen
2010/0258601 A1 10/2010 Thrope
2010/0327030 A1 12/2010 Yang
2011/0083254 A1 4/2011 Trutna et al.
2011/0309121 A1 12/2011 Dooley et al.
2012/0152990 A1 6/2012 Kulas
2013/0086774 A1 4/2013 Krasinski et al.
2013/0205476 A1 8/2013 Gentile et al.
2013/0326790 A1 12/2013 Cauwels et al.
2016/0003269 A1 1/2016 Russell-Clarke et al.
2016/0010673 A1 1/2016 Russell-Clarke et al.
2016/0025119 A1 1/2016 Russell-Clarke et al.
2016/0037878 A1 2/2016 Yabe et al.
2016/0040695 A1 2/2016 Perkins et al.
2016/0058375 A1 3/2016 Rothkopf
2016/0069371 A1 3/2016 Chen et al.
2016/0128209 A1 5/2016 Yoon et al.
2016/0154425 A1 6/2016 Yang et al.
2016/0192526 A1 6/2016 Gao et al.
2016/0215799 A1 8/2016 Ely et al.
2016/0261037 A1 9/2016 Chen et al.
2016/0278203 A1 9/2016 Nakayama
2017/0086538 A1 * 3/2017 Siahaan ..... A44C 5/14

FOREIGN PATENT DOCUMENTS

CN 1236583 A 12/1999
CN 2575724 9/2003
CN 200983868 12/2007
CN 201709560 1/2011
CN 102202533 9/2011
CN 202026953 11/2011
CN 202587325 12/2012
CN 202664274 1/2013
CN 202704189 1/2013
CN 103376734 A 10/2013
CN 103488076 1/2014
CN 203407616 U 1/2014
CN 105371076 3/2016
EP 2098131 3/2009
EP 2633776 9/2013

(56) References Cited

FOREIGN PATENT DOCUMENTS

| | | |
|---|---|---|
| FR | 1291875 | 4/1962 |
| FR | 2492238 | 4/1982 |
| FR | 2532239 | 3/1984 |
| GB | 464417 | 4/1937 |
| GB | 1491532 | 11/1977 |
| GB | 2113975 | 8/1983 |
| GB | 2355281 | 4/2001 |
| JP | H06189814 | 7/1994 |
| JP | 2001060997 | 3/2001 |
| JP | 2005143988 | 6/2005 |
| JP | 2005318247 | 11/2005 |
| JP | 2006102026 | 4/2006 |
| JP | 3134581 | 8/2007 |
| JP | 2009124652 | 6/2009 |
| JP | 2012248580 | 12/2012 |
| KR | 200320475 | 7/2003 |
| KR | 200396918 | 9/2005 |
| WO | WO2010/036090 | 4/2010 |
| WO | WO2011/0048344 | 4/2011 |
| WO | WO2012/160195 | 11/2012 |

OTHER PUBLICATIONS

Author Unknown, "Tajan," http://www.tajan.com/pdf/7812.pdf, 2 pages, Dec. 10, 2007.

Author Unknown, v2.0 Ikepod Has Landed . . . again . . . , http://qp.granularit.com/media/38876/QP24_Ikepod.pdf, 3 pages, at least as early as Apr. 25, 2015.

Chinese Utility Model Patent Evaluation Report (UMPER) from Chinese Patent Application No. ZL201720276345.9, dated May 16, 2018, 17 pages.

* cited by examiner

FRICTIONAL STABILIZATION OF BAND AND SECUREMENT MECHANISM

CROSS-REFERENCE TO RELATED APPLICATION

This application is a nonprovisional patent application of U.S. Patent Application No. 62/235,515, filed Sep. 30, 2015 and titled "Frictional Stabilization of Band and Securement Mechanism," the disclosure of which is hereby incorporated herein by reference in its entirety.

FIELD

The described embodiments relate generally to attachment bands for portable electronic devices. More particularly, embodiments relate to a device for controlling the resistance of a band associated with an attachment device, in order to stabilize the band.

BACKGROUND

Recent advances in portable computing have led to increased use of portable electronic devices. Many users prefer to wear certain electronic devices, such as watches, fitness trackers, and even mobile phones. Often, such electronic devices are attached to a band by a securement mechanism. The band encircles part of the wearer, while the securement mechanism attaches the band to the device. In some cases, the band may loop about the securement mechanism. This may permit the band to rotate or otherwise move about the securement mechanism which may, in turn, alter the relative position of the electronic device with respect to the band.

Flexible bands or bracelets have been used to secure wristwatches and other devices to the person of a user for many years. These bands have made from a variety of materials including leather, cloth, plastic metal inks, and so on. Such bands often permit the portable electronic device to rotate, slip, or otherwise move, thereby changing the orientation and/or fit of the device (and/or band) with respect to the wearer.

SUMMARY

Disclosed embodiments may provide a user with a functional and aesthetically pleasing securement mechanism to affix an electronic device to a band, while retaining a chosen position, alignment, and/or orientation between the electronic device and band. When the band affixes the electronic device to a user, a frictional insert may increase friction between the securement mechanism and the band. This increase in friction may likewise increase the overall force required to move, rotate or otherwise dislodge the electronic device with respect to the band.

One embodiment takes the form of a portable electronic device, comprising: a body; a securement mechanism affixed to the body; a pin attached to the securement body; a band forming a loop through which the pin passes; and a frictional insert within the loop, and engaging the pin and the band; wherein: the frictional insert is shaped to occupy a space defined by the pin and the band; the frictional insert tapers along its length; and the frictional insert is configured to increase friction between the pin and the band, thereby reducing motion of the band with respect to the pin.

Another embodiment takes the form of a method for controlling motion of a band with respect to a securement mechanism of an electronic device, comprising: adjusting an offset distance between a pin of the securement mechanism and the band; in response to adjusting the offset distance, increasing a friction between an elastic element and the band; in response to increasing the friction between the elastic element and the band, maintaining a spatial relationship between the pin and the band.

Still another embodiment takes the form of an attachment mechanism for an electronic device, comprising: an attachment structure; a flexible strap attached to the securement mechanism; and a frictional device comprising: a body; and a neck extending from the body; wherein: the frictional device is adjacent, and connected to, the attachment structure and the flexible strap; the flexible strap defines a gap; the frictional device is positioned within the gap; the body engages the flexible strap; and the neck frictionally engages the attachment structure.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
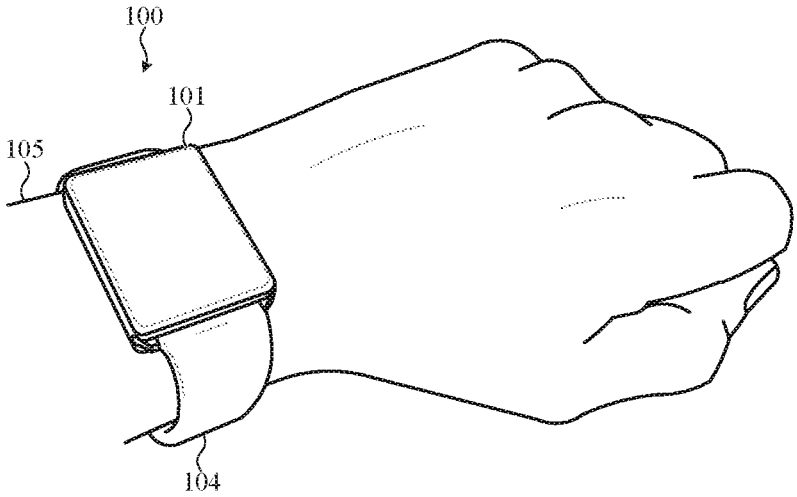
FIG. 1 shows a portable electronic device attached to a user by a band.

Reference will now be made in detail to representative embodiments illustrated in the accompanying drawings. It should be understood that the following descriptions are not intended to limit the disclosure to any particular or preferred embodiment. To the contrary, it is intended to cover alternatives, modifications, and equivalents as can be included within the spirit and scope of the described embodiments as defined by the appended claims.

The following disclosure relates to an attachment band or tether for securing a portable electronic device to a user or to an object, such as a bicycle, article of clothing, structure, and so on. The band is flexible to allow it to conform to a wrist or other portion of the person of a user, or other suitable structure. An attachment pin passes through a loop of the band and is used to affix the band to an accessory, such as an electronic device, timekeeping device, wearable device, and so on. For example, the accessory may be a watch, fitness tracker, medical monitor, mobile phone, and so on.

In a particular embodiment, a frictional device is included within a loop defined by an attachment band. The frictional device stabilizes the band and prevents it from rotating about the attachment pin (or simply "pin") so that the band does not change its orientation with respect to the attached electronic device or other accessory (or vice versa). The frictional device may reduce space between the pin and the band, as well as increase friction with respect to one or both of the pin and the band. Accordingly, the band is less likely to rotate about the pin and can sustain a greater load before rotating.

In some embodiments, the frictional device may be a rib or other protrusion. The rib may project from the band toward the pin, or vice versa. The rib may engage the pin if it projects from the band, or may engage the band if it projects from the pin. In one embodiment, a hole defined by, or in, the band (through which the pin passes) may be filled with a material, such as urethane, that may be cured and shaped to form the rib or other protrusion.

In other embodiments, an elastomer may be fitted about the pin or other structure about which the band passes. The elastomer may be molded to the pin, or may be a sleeve, ring or the like that is fitted on the pin. The elastomer may be inserted into a gap defined by two parts of the pin. For example; the two parts of the pin may define the gap at a point where the two parts join one another.

Where an elastomer is used as the frictional device, an amount of friction between pin and band may be controlled by varying one or more dimensions of the pin. The thickness of the elastomer may be varied by compressing the two parts of the pin (e.g., moving them toward one another), which may cause the elastomer to likewise compress along an axis parallel to the direction of motion of the parts. Compressing the elastomer may reduce a surface area of the elastomer that is in contact with the band encircling the pin, thereby reducing friction.

These and other embodiments are discussed below with reference to FIGS. 1-14. However, those skilled in the art will readily appreciate that the detailed description given herein with respect to these Figures is for explanatory purposes only and should not be construed as limiting.

FIG. 1 illustrates a system 100 including a portable electronic device 101 and a band 104 attached thereto. The band 104 may secure the electronic device 101 to a wearer 105, another electronic device, a surface, a post, or any other securement structure. In the embodiment 100 shown in FIG. 1, the band electronic device 101 takes the form of a watch.

Figure 2:
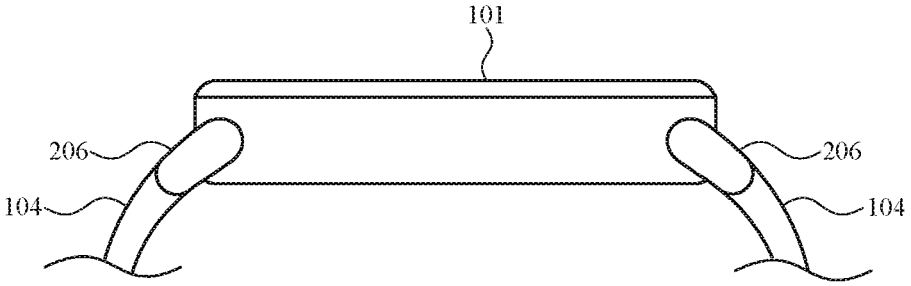
FIG. 2 shows the electronic device, a securement mechanism, and a band.

FIG. 2 illustrates the watch 101 and band 104 of FIG. 1, as well as a securement mechanism 206 that affixes the band 104 to the watch 101 (or other electronic device, in other embodiments). As shown, each side of the band 104 is connected to the watch 101 by its own, separate securement mechanism 206. The band and securement mechanism may together form an attachment mechanism.

In some embodiments the securement mechanism 206 may releasably couple the band 104 and watch 101. In these embodiments, the securement mechanism 206 may be removed from a channel or other aperture defined in a body of the electronic device 101, which in turn may decouple the band 104 from the electronic device. In certain embodiments, the securement mechanism(s) 206 may be permanently affixed to the electronic device 101 and the band 104 may be removed from the securement mechanism(s). The securement mechanism 206 can take substantially any shape and can be substantially any size, and is generally shaped and sized to be received in a channel of the electronic device 101.

Figure 3:
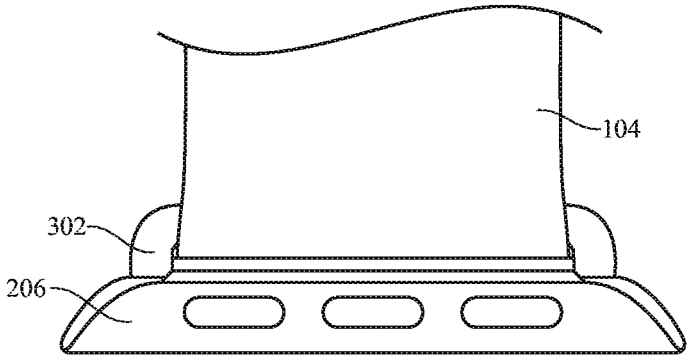
FIG. 3 shows a securement mechanism connected to a band.

FIG. 3 illustrates the securement device 206 and its relationship to the band 104. As shown, the band 104 is attached to the securement mechanism 206 by a pin 302. In particular, the band 104 wraps about the pin 302. The band 104 may be sewn, glued, or otherwise affixed to itself to form the loop extending about pin 302. In some embodiments, the securement device 206 may be omitted. Instead, the pin 203 may directly connect the band 102 to the watch 101; the pin may be received in recesses defined within a body of the watch, for example.

In one embodiment, band 104 is made from a flexible material such as leather, plastic, cloth or other woven strands, a polymer, or other flexible or semi-flexible material. Band 104 may also be made a series of substantially rigid structures (or materials) that may move with respect to one another, such as metal links, coils that cooperate to form a metal mesh, and so on. Generally, the band 142 is sufficiently flexible to encompass a wrist of a user and to form a loop about the pin 302.

Figure 4:
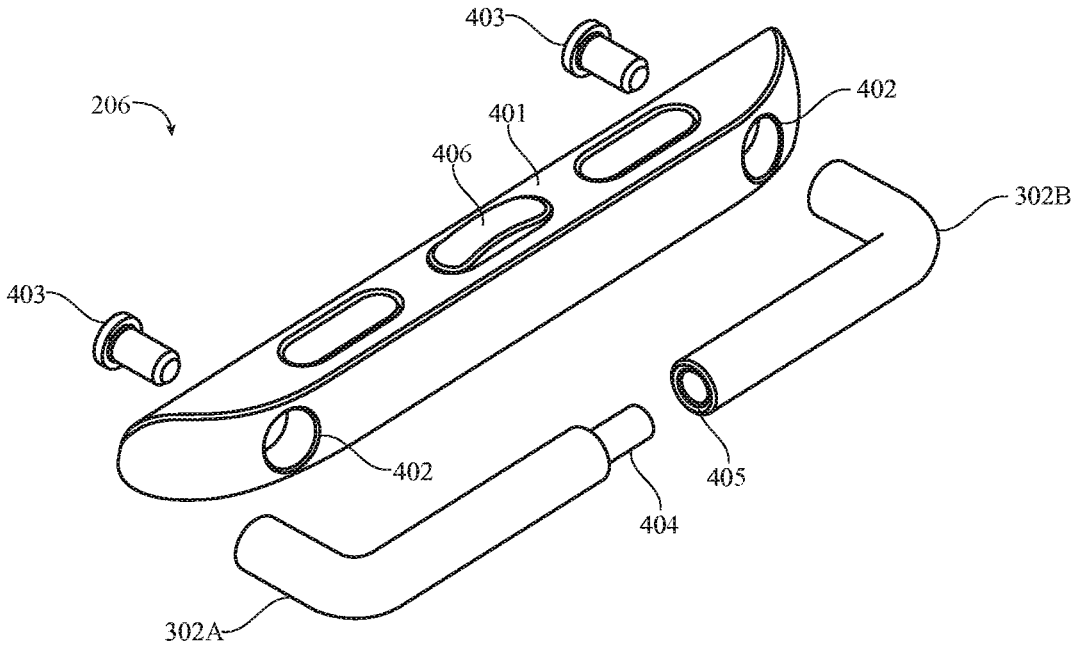
FIG. 4 is an exploded view of the securement mechanism of FIG. 3.

FIG. 4 illustrates the securement device 206 in an exploded view. The securement device may include a securement body 401 that is sized and/or shaped to fit within an aperture of the electronic device 101, as shown in FIG. 2. The body 401 may be formed from metal, plastic, ceramic, or any other suitable material.

In some embodiments, the body 401 is configured to slide into the aperture of the electronic device 101. The body 401 may be retained in the aperture by one or more protrusions 404 or teeth that extend into a cavity or other recess within the aperture. The protrusion(s) 404 may secure the securement device 206 within the cavity; a user may depress the protrusion or cause the protrusion 404 to be depressed to remove it from the cavity and thus permit the body 401 to exit the aperture.

A multi-part pin 302 is formed from a first pin section 302A and a second pin section 302B, although in some embodiments a unibody pin may be used. The first pin section 302A may define a male fitting 404 at one end, while the second pin section 302B may define a female fitting (e.g., cavity) 405 at one of its ends. The male fitting 404 is sized to be received within the female fitting 405. In some embodiments, the male fitting may be threaded and the female fitting complementarily threaded, so that the first pin section 302A may be screwed to the second pin section 302B. In other embodiments, the male fitting 404 may frictionally engage inner sidewalls of the female fitting 405, and the pin 302 may rely on friction to maintain engagement between the first pin section 302A and second pin section 302B. In still other embodiments, the first pin section 302A and second pin section 302B may be adhered, welded, soldered, or otherwise affixed to one another. Some embodiments may configure the first and second pin sections 302A, 302B to releasably mate with one another while other embodiments may be configured such that they permanently mate.

Fasteners 403 may extend through fastening apertures 402 in the body 401 of the securement mechanism 206 and affix the first and second pin sections 302A, 302B to the body. The fasteners 403 may be screws, pins, plugs, rivets, or the like.

Typically, but not necessarily, the securement mechanism 206 is assembled and affixed to a band 104 in the following manner. A band 104 may be positioned between the first and second pin sections 302A, 302B. The first pin section 302A is mated to the second pin section 302B, either releasably or fixedly, such that the pin extends through a loop of the band 104. (In some embodiments, the pin sections may be mated first and the band then looped around them.) Non-mated ends of the pin 302 are inserted into the fastening apertures 402. Fasteners 403 are inserted into the fastening apertures 402 from an opposing side of the securement body 401, and ultimately into the non-mated ends of the pin 302. The fasteners 403 are affixed to the pin 302 to maintain the alignment and position of the pin 302 and securement body 401.

In some embodiments, although the band 104 may extend around the pin 302 of the securement mechanism 206, the band may be loose on the pin. Thus, the band may slip, shift or otherwise move, translationally and/or rotationally, with respect to the pin. This may affect a fit of the band 104 with respect to a wearer, the electronic device 101, and/or a retaining structure.

Figure 5:
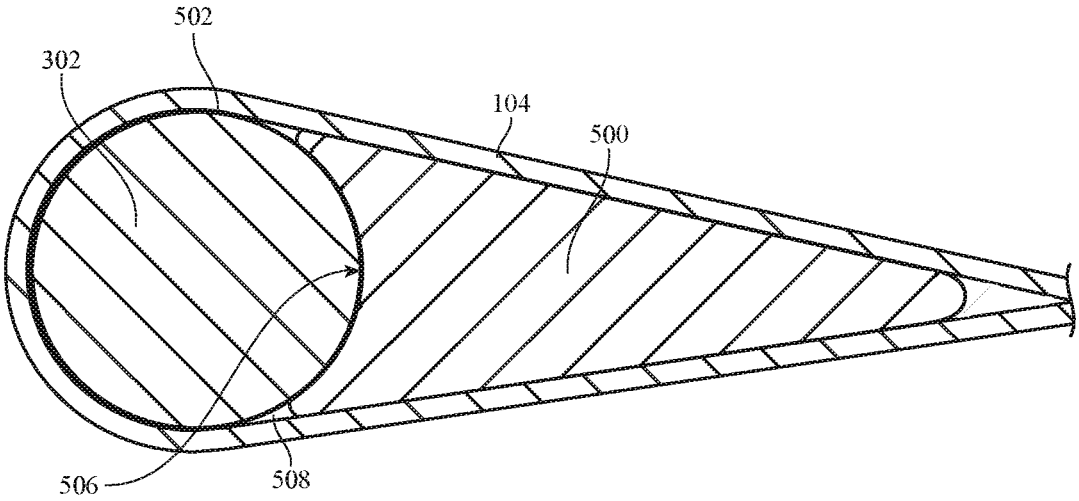
FIG. 5 shows a cross-section view of a band extending around a pin and an insert.

The discussion now turns to FIG. 5, which is a cross-section showing a pin 302 retained within a loop defined by a band 104. In order to mitigate translation and/or rotation of the band 104 with respect to the pin 302, a frictional insert 500 may be placed within a loop of the band, abutting the pin 302 and an interior surface 502 of the band 104. The insert 500 generally frictionally couples the pin 302 to the band 104 (e.g., it increases friction therebetween). By increasing friction between the pin 302 and band 104, the insert 500 may likewise increase the amount of force required to rotate the band about the pin, which may maintain the relative position of a secured electronic device with respect to the band. This may stabilize the electronic device with respect to the band, thus increasing comfort for a wearer and/or fit of the band and device.

In some embodiments, the frictional insert 500 (or simply "insert") may be made from polyurethane. In other embodiments, any suitable rigid, semi-rigid, or elastomeric material may be used, including rubber and other polymers.

Insert 500 may be generally wedge-shaped with a concave end surface 506. Put another way, the insert 500 may taper along its length, from a first end abutting the pin to a second, smaller end (which may be pointed, rounded, or otherwise shaped) near a point where the band loops back to contact itself (e.g., the smaller end of the space defined by the loop). A majority of the wedge sidewalls may contact an interior surface of the band and, in some embodiments, may be affixed thereto. The concave end surface 506 may abut and frictionally engage the pin 302, band 104, or both. The insert 500 may be sized to occupy a majority of space within the band 104 loop that is not occupied by pin. Alternately, the insert 500 may be sized to abut at least part of the pin 302 and band 104 interior, but may not occupy a majority of volume inside the loop. For example, a void space 508 may be present between pin 302 and part of loop 104.

A width of the insert 500 may be less than the width of the band 104, or may be substantially the same width as the band. Typically, although not necessarily, the insert 500 is not visible when the band 104 is attached to the securement mechanism 200.

The insert 500 may rotationally and/or translationally stabilize the pin 302 with respect to the band 104. For example, the concave end surface 506 may create sufficient friction with the pin 302 that the pin 302 does not rotate or translate, with respect to the insert 500, under normal loads and/or operating conditions. Likewise, the insert 500 may frictionally engage the band 104 to prevent motion of the band with respect to the insert, at least under normal operating loads and conditions. Since both the pin 302 and loop 104 are rotationally and/or translationally fixed with respect to the insert 500, they are likewise fixed with respect to one another. Similarly, in embodiments where the insert is affixed to the band 104, the insert 500 may stabilize the pin 302 and prevent the pin from moving with respect to the band.

In still other embodiments, the frictional device/insert 500 may be affixed to both the pin 302 and the band 104. For example, the insert 500 may be adhered to one or both of the band 104 (e.g., flexible structure) and pin 302.

In some embodiments, the insert 500 may be formed by depositing polyurethane or a similar polymer (or other material) in the interior of the loop formed by the band 104. The insert material may be deposited in a liquid form and cured or otherwise hardened within the loop, as one non-limiting example. The insert may initially occupy all or a majority of volume within the loop, including a space in which the pin 302 may ultimately rest, as shown in FIG. 5. Further, curing the insert material while it contacts the loop 104 may bond the insert to the loop, thereby creating a relatively strong engagement between the two. Further, this may ensure that the shape of the insert 500 generally conforms to a shape of an interior of the loop formed by the band 104.

A cavity may be formed in insert 500 to accommodate pin 302, once the insert material has cured or otherwise solidified. The cavity may be formed by machining one end of the insert 500, or may be formed through the insert 500. In the former example, the insert may be bored, cut, or otherwise machined to a particular shape; continuing the example, the insert 500 may be machined to form the concave surface 506. In the latter example, a hole may be machined through the insert 500 such that the insert 500 ultimately surrounds a pin 302 passing through the band 104 loop.

In either example, the insert 500 may be machined to result in a relatively tight fit with the pin 302, thereby frictionally engaging the pin and preventing rotation and/or translation of the pin under typical operating loads and conditions. By controlling the size of the hole formed in the aperture and/or dimensions of concave surface 506 (or other end surface structure), an amount of friction between insert 500 and pin 302 may be controlled. Thus, the insert 500 may be configured to generate a desired amount of frictional force with pin 302. This, in turn, permits relatively fine control of the maximum operating load, force, and/or other conditions under which the pin 302 will not move with respect to the band 104.

In some embodiments, a coating may be placed on the machined surface of insert 500, such as concave surface 506. The coating may be added before or after the pin 302 passes through the loop, and may serve to more consistently engage the insert 500 with the pin 302. The coating may increase friction between the two in some embodiments, or it may decrease friction in some embodiments. For example, the coating may be polyurethane configured to fill a gap between the insert and the pin, or the coating may be a lubricant configured to reduce friction between the gap and insert in other embodiments.

Figure 6:
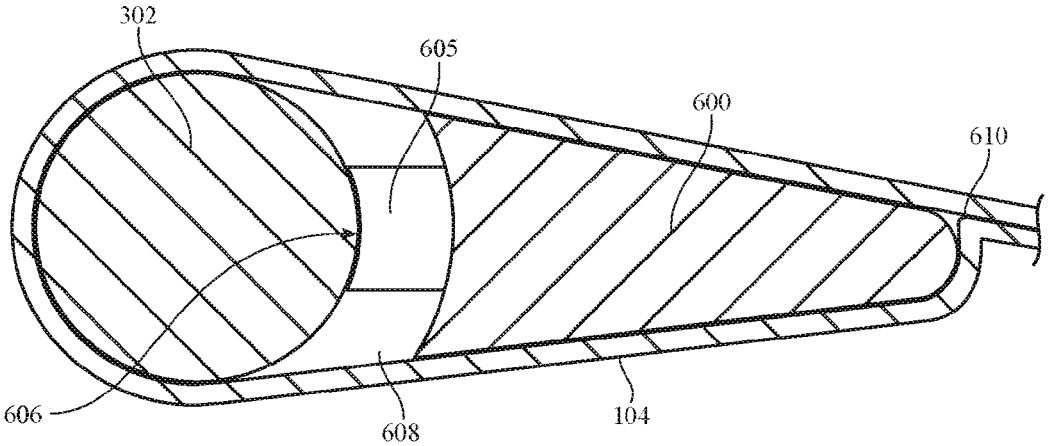
FIG. 6 shows a second cross-section view of a band extending around a pin and a second type of insert.

FIG. 6 illustrates, in cross-section, another sample frictional device 600 (similar to the insert 500 discussed above) is positioned within a loop of a flexible strap, such as a band 104. As with the embodiments of FIG. 5, the frictional device 600 may abut (or be formed on) the flexible strap 104 and the pin 302, or other securement mechanism. Here, however, neck 605 extends from the body of the frictional device 600 to engage a sidewall of the securement mechanism 302. The neck 606 defines a concave contact surface 606 that engages the securement mechanism's sidewall. The neck 605 may be formed integrally with the body of the frictional device 600, or may be formed separately therefrom. For example, the neck 605 may be a rib extending from the body 600 of the frictional device. The frictional device may be machined to form the neck 605, such that neck and body are unitary and made from the same material. Alternately, neck 605 may be a second material affixed to the body of frictional device 600. For example, the frictional device body may be cured around a protrusion that forms the neck 605.

As illustrated in FIG. 6, neck 605 may be smaller in multiple dimensions than the body of frictional device 600. For example, the neck 605 may not abut the flexible strap 104. Further and as shown, the neck 605 is not cross-sectioned in the view of FIG. 6. In this embodiment, the neck 605 may not extend along an entire width of the flexible strap 104 (e.g., in and out of the page in the view of FIG. 6), and in any event may have a smaller width than the body of frictional device 600.

Generally, the frictional device 600 (including neck 605) operates in a similar fashion as previously described with respect to the insert 500 of FIG. 5 in order to reduce or prevent a likelihood of the securement mechanism 302 (e.g., pin) moving with respect to the flexible strap 104 (e.g., band) Likewise, the frictional device 600 may be formed in the same or similar fashions as discussed above with respect to insert 500.

As also shown in FIG. 6, the flexible strap 104 may form a loop and be affixed to itself at a seam or other joint 610. The joint may be formed by sewing the flexible strap 104 to itself, adhering the flexible strap to itself, or in any other suitable fashion. The frictional device 600 may provide structural support to the portion of the flexible strap 104 forming the loop, thereby ensuring the flexible strap does not collapse inward.

Figure 7A:
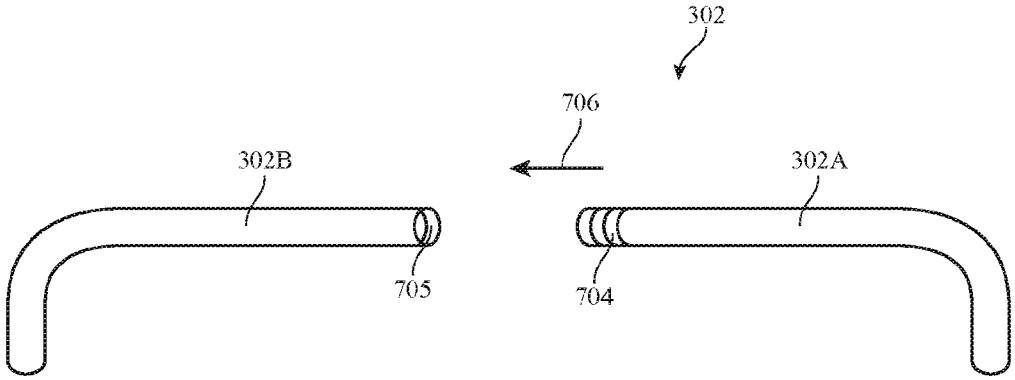
FIG. 7A is an exploded view of a multi-section pin.
Figure 7B:
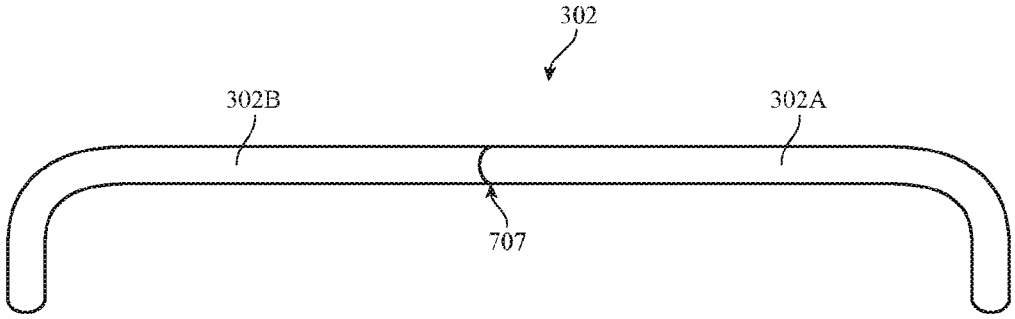
FIG. 7B shows the multi-section pin of FIG. 7A, as assembled.

Referring to FIGS. 7A and 7B, a multi-part pin 302 (e.g., securement mechanism) is shown. As previously discussed, the multi-part pin 302 may be formed from a first pin section 302A and second pin section 302B. A male fitting 704 may mate with a female fitting 705 (similar to the male and female fittings previously discussed). The fittings may be threaded or they may be friction-fit fittings. Generally, the male fitting 704 is moved in direction 706 to mate with the female fitting 705. This results in the formed pin 302 shown in FIG. 7B, which also illustrates a seam 707 between the two pin sections 302A, 302B.

Figure 8:
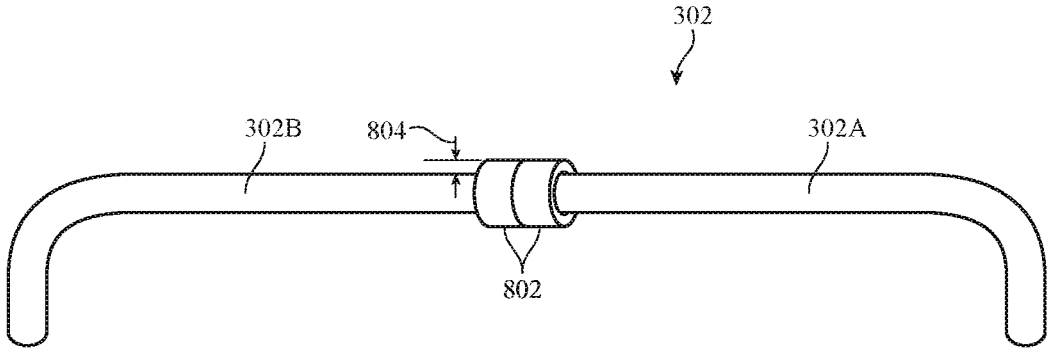
FIG. 8 shows a pin having an elastic collar.

FIG. 8 illustrates the pin 302 of FIGS. 7A and 7B with elastic collars 802 fitted about the pin. The elastic collars 802 generally sit within the seam 707, although in alternative embodiments they may cover the seam. Each pin section 302A, 302B may have its own elastic collar; the collars may be placed about the pin sections prior to joining the pin sections together or after so joining. Further, in some embodiments a single elastic collar 802 is placed about one or both pin sections 302A, 302B. The elastic collar may be made of any suitable material, such as a rubber, polymer, or other elastomer.

An outer surface of the elastic collars 802 is offset from an outer surface of the pin sections 302A, 302B by an offset distance 804. Put another way, a diameter (or height, or width) of the collars 802 is greater than a corresponding diameter (or height, or width) of the pin sections 302A, 302B. Although reference is made to diameters, it should be appreciated that the collars 802 and/or pin sections 302A, 302B need not be round. Accordingly, the term "diameter" is used for convenience and in an encompassing sense. Further, it should be appreciated that the offset distance 804 is exaggerated in FIG. 8 for purposes of illustration.

Figure 9:
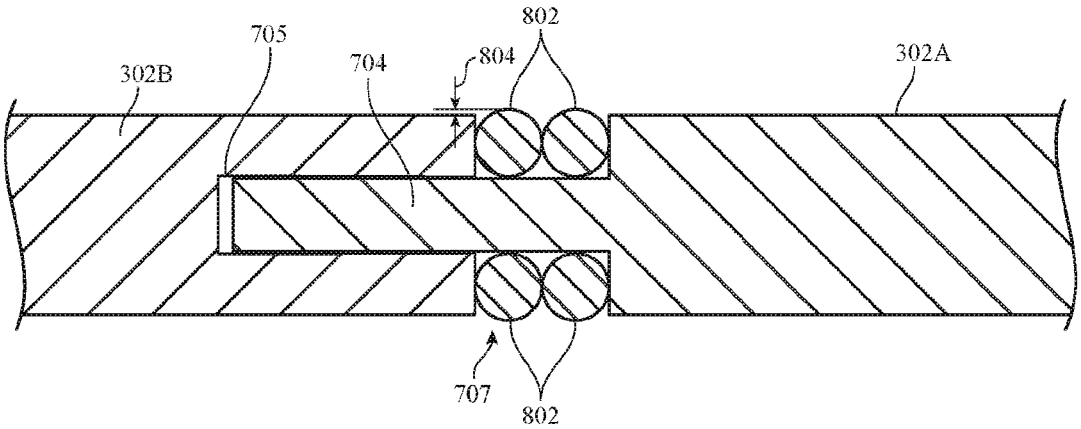
FIG. 9 is a cross-section view showing a pin with an elastic collar received in a seam.

FIG. 9 shows a cross-sectional view of the pin sections 302A, 302B and their mating structure. For example, male fitting 704 is shown received within female fitting (e.g., cavity) 705. The elastic collars 802 sit at least partly within seam 707. Further, the elastic collars 802 project above the surface of the pin sections 302A, 302B by the offset distance 804.

The offset distance 804 may be modified by moving the pin sections 302A, 302B closer or farther away from one another. For example, male fitting 704 may be moved deeper into female fitting 705. This compresses the elastic collars 802 (or collar, in some embodiments), which causes them to bulge outwardly, away from the pin sections 302A, 302B. Thus, the offset distance 804 increases. As male fitting 704 is moved out of cavity 705, the elastic collars 802 may decompress, thereby reducing the offset distance 804. As discussed below with respect to FIG. 11, adjusting the offset distance may a friction between the elastic collars 802 and a band 104 encircling the collars and pin sections 302A, 302B.

In some embodiments, the male fitting 704 and female fitting 705 may be threaded so that their spatial relationship may be set and maintained which, in turn, maintains the offset distance 804. In other embodiments, detents, projections, and the like may be used to set and maintain the spatial relationship.

Figure 10:
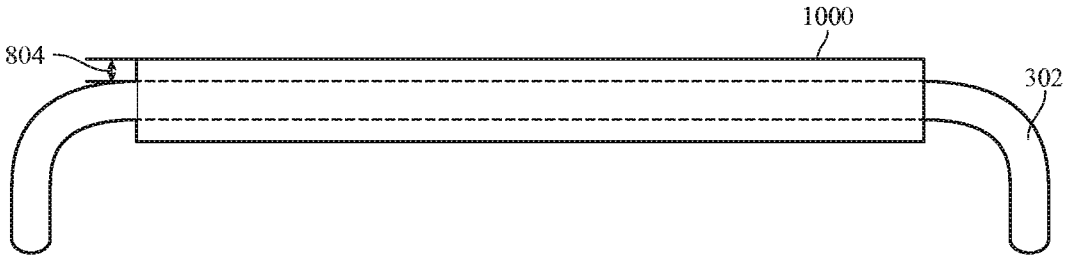
FIG. 10 shows a pin having a second type of elastic collar disposed about the pin.

FIG. 10 illustrates an alternative embodiment of a collar 1000 about a pin 302. The collar 1000 sits around an exterior surface of the pin 302, rather than in a seam. An outer surface of the collar 1000 is nonetheless separated from an outer surface of the pin 302 by an offset distance 804. The embodiment shown in FIG. 10 may be particularly suitable for a unitary pin 302, or when the offset distance 804 does not need to be manipulated.

Figure 11:
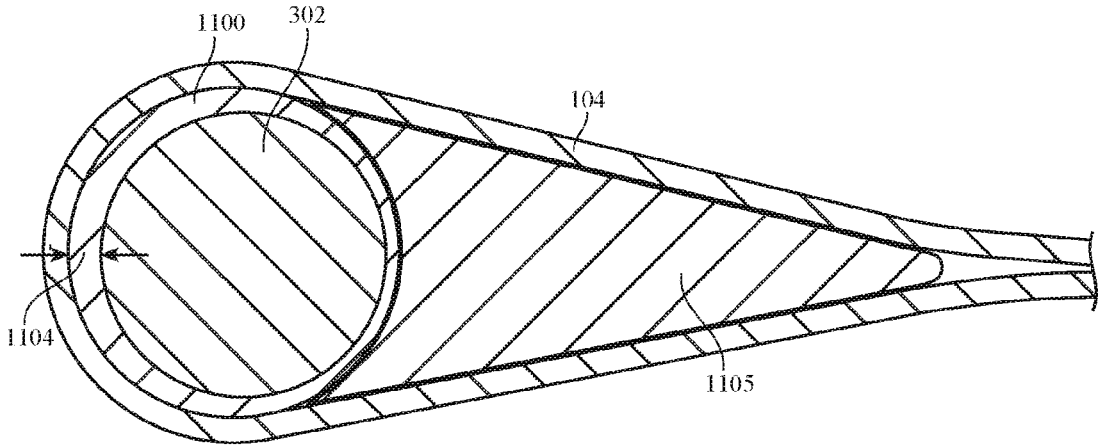
FIG. 11 is a cross-sectional view of a pin and elastic collar within a loop of a band.

FIG. 11 is a cross-sectional view of a pin 302 received within a loop of a band 104. As with prior embodiments, an insert 1105 is positioned within the loop and may be affixed to the band 104. An elastic collar 1100 encircles the pin 302. The elastic collar 1100 may sit within a seam of the pin 302, as with the embodiment of FIG. 7, or may encircle the pin 302, as with the embodiment of FIG. 10.

An outer surface of the elastic collar 110 may contact an interior of the band 104 and the insert 1105. Accordingly, in this embodiment, the insert 1105 does not contact the pin 302 at all. Rather, the elastic collar 1100 frictionally abuts the insert 1105 and has a friction fit with the pin 302. The friction between pin 302 and collar 1100, as well as collar 1100 and insert 1105 (and/or band 104), may control and/or prevent rotational and/or translational motion of the pin relative to the band.

The amount of friction between the elastic collar 1100 and band 104, or insert 1105, may be varied by adjusting an offset distance 1104 between the outer surface of the pin 302 and inner surface of the band 104. The offset distance 1104 may be increased by increasing a compressive force on the collar, which may cause the collar to bulge or otherwise expand outward. As discussed in previous embodiments, the sections of a multi-part pin may be moved toward one another to increase compressive force in a first direction on the collar, which causes the collar to expand outward in a direction transverse to the force. In the embodiment of FIG. 11, the collar 1100 thus expands outward from the pin 302 toward an interior surface of the band 104. This increases the friction between collar 1100 and band 104 (and/or insert 1105), thereby maintaining translational and/or rotational alignment of the pin and band. This, in turn, maintains translation and/or rotational alignment of the securement mechanism and, ultimately, the electronic device with respect to the band.

Likewise, the offset distance may be decreased by reducing the force exerted on the collar 1100 by the pin 302, or any other structure configured to exert such force. This reduces the offset distance 1104 and thus the friction between collar and pin, and/or collar and insert 1105. Thus, the pin may have a variable friction fit within the band.

In certain embodiments the pin 302 may be centered within the elastic collar 1100, although this is not necessary. As shown in FIG. 11, the pin may be off-center with respect to a center of the elastic collar 1100.

It should be appreciated that certain embodiments may omit the insert 1105 entirely. Instead, the elastic collar may frictionally engage only the band 104. The elastic collar 1100 may be sized to reduce or prevent lateral motion of the pin 302 relative to the band 104 in the absence of the insert, while maintaining friction with the band to prevent or reduce rotational motion.

Some embodiments may permit a user to adjust friction between the pin and the band, and thus change a feel of the band when worn. The user may lengthen or shorten the pin, for example, by moving the pin sections relative to one another. This may adjust the friction between the elastic collar and band and/or insert, as described. Accordingly, some embodiments may be user-configurable to provide a more comfortable fit. Further, where the electronic device 100 incorporates a biometric sensor, the user may increase friction between the band and the securement mechanism (e.g., the pin or the like) to hold the electronic device in a stable position, which in turn may enhance operation of the biometric sensor.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. An attachment mechanism for a watch, the attachment mechanism comprising:
- a securement mechanism removably attachable to a body of the watch;
- a pin attached to the securement mechanism;
- a band forming a loop through which the pin passes; and
- a frictional insert within the loop, and engaging the pin and the band; wherein:
  - the frictional insert is shaped to occupy a space defined by the pin and the band;
  - the frictional insert tapers along its length from a first end abutting the pin to a second, smaller end that is opposite the first end; and
  - the frictional insert is configured to increase friction between the pin and the band, thereby reducing motion of the band with respect to the pin.

2. A watch comprising:
- a watch body; and
- the attachment mechanism of claim 1, wherein the securement mechanism is removably attached to the watch body.

3. The attachment mechanism of claim 1, wherein the frictional insert is formed on the band.

4. The attachment mechanism of claim 3, wherein the frictional insert is made from polyurethane.

5. The attachment mechanism of claim 1, wherein the frictional insert comprises:
- an insert body having a first dimension and abutting the band; and
- a neck having a second dimension and abutting the pin; wherein
- the first dimension is less than the second dimension.

6. The attachment mechanism of claim 5, wherein the neck is a rib formed unitarily with the insert body.

7. The attachment mechanism of claim 5, wherein the insert body is formed from a separate material from the neck.

8. The attachment mechanism of claim 1, wherein the frictional insert is an elastic collar.

9. The attachment mechanism of claim 8, wherein:
- the elastic collar is received within a seam of the pin; and
- a surface of the elastic collar is offset by an offset distance from a surface of the pin.

10. The attachment mechanism of claim 9, wherein the offset distance is controlled by compressing the elastic collar.

11. A method for controlling motion of a band with respect to a securement mechanism of an electronic device, comprising:
- adjusting an offset distance between a securement mechanism and the band;
- in response to adjusting the offset distance, increasing a friction between an elastic element and the band; and
- in response to increasing the friction between the elastic element and the band, maintaining a spatial relationship between the securement mechanism and the band.

12. The method of claim 11, wherein the elastic element encircles a pin of the securement mechanism.

13. The method of claim 11, wherein the elastic element is received in a seam of the securement mechanism.

14. The method of claim 13, wherein of adjusting the offset distance comprises moving a first pin section relative to a second pin section, thereby changing a compression of the elastic element.

15. The method of claim 14, wherein the offset distance corresponds to a distance between an outer surface of the elastic element and an outer surface of the pin.

16. The method of claim 15, wherein maintaining a spatial relationship between the pin and the band comprises maintaining a translational and a rotational alignment between the pin and the band.

17. The method of claim 15, further comprising maintaining translational and rotational alignment of the electronic device with respect to the band.

18. An attachment mechanism for a watch, the attachment mechanism comprising:
- a securement mechanism comprising:
  - a body; and
  - a pin affixed to the body;
- an elastic collar about the pin;
- a flexible strap; and
- a frictional device;
- wherein:
  - the flexible strap defines a gap;
  - the frictional device is positioned within the gap;

the frictional device engages the flexible strap; and the frictional device frictionally engages the elastic collar.

19. The attachment mechanism of claim 18, wherein the frictional device affixed to the flexible strap.

20. A watch comprising:

a watch body; and the attachment mechanism of claim 18, wherein the securement mechanism is removably attached to the watch body.

* * * * *